US011192228B2

(12) United States Patent
Bardo

(10) Patent No.: US 11,192,228 B2
(45) Date of Patent: Dec. 7, 2021

(54) FLOOR COVERING FASTENERS AND ADHESIVES REMOVAL TOOL

(71) Applicant: John Bardo, Grass Valley, CA (US)

(72) Inventor: John Bardo, Grass Valley, CA (US)

( * ) Notice: Subject to any disclaimer, the term of this patent is extended or adjusted under 35 U.S.C. 154(b) by 0 days.

(21) Appl. No.: 15/894,528

(22) Filed: Feb. 12, 2018

(65) Prior Publication Data

US 2019/0247992 A1 Aug. 15, 2019

(51) Int. Cl.

| | |
|---|---|
| ***B25F 1/00*** | (2006.01) |
| ***A47L 13/08*** | (2006.01) |
| ***B25G 1/10*** | (2006.01) |
| ***B25C 11/00*** | (2006.01) |

(52) U.S. Cl.

CPC ..... *B25F 1/00* (2013.01); *A47L 13/08* (2013.01); *B25C 11/00* (2013.01); *B25G 1/102* (2013.01)

(58) Field of Classification Search

CPC ..... A47L 13/02; A47L 13/022; A47L 13/08; B25C 11/00; B25F 1/00; B25G 1/102

USPC ..... 7/166; 81/45, 46; 254/131.5; D8/88, D8/89; 30/169–172

See application file for complete search history.

(56) References Cited

U.S. PATENT DOCUMENTS

| | | | | |
|---|---|---|---|---|
| 5,695,171 | A * | 12/1997 | Shine | B25C 11/00 254/25 |
| 6,029,545 | A * | 2/2000 | Harpell | E04D 15/003 254/131.5 |
| 6,817,590 | B2 * | 11/2004 | Gargiulo | B28B 13/06 249/205 |
| 2007/0051210 | A1 * | 3/2007 | Harpell | E04D 15/003 81/45 |
| 2010/0224032 | A1 * | 9/2010 | Harpell | E04D 15/003 81/45 |
| 2014/0182107 | A1 * | 7/2014 | Nestor | B66F 15/00 29/426.5 |

* cited by examiner

*Primary Examiner* — William V Gilbert

(57) ABSTRACT

The present invention is a floor covering fasteners and adhesives removal tool that allows for the quick removal of a staple, tack nail, and/or adhesives from a material without causing damage. The staple remover portion of the multi-purpose tool works with its forked blade for slipping underneath staples, and using the prying plate oval shape to free the staple. The tack strip nail puller portion of the multi-purpose tool having the nail slot is typically moved laterally relative to the nail. More specifically, the nail slot engages the nail where the force moving prying plate by the handle will sufficient to free the nail from the surface. The glue scraper portion of the multi-purpose tool has a bevel edge to allow the glue scraper to assume more nearly a right angular position to the floor surface sufficient to free the glue residue from the surface.

1 Claim, 13 Drawing Sheets

FLOOR COVERING FASTENERS AND ADHESIVES REMOVAL TOOL

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention relates to floor covering fasteners and adhesives removal tool used by flooring contractors and others involved in the installation of flooring. More specifically, the present invention relates to a multi-purpose tools used in the removal of staples, tack strip nail and carpet glue efficiently without damaging the floor surface.

BACKGROUND OF THE INVENTION

Carpet and flooring contractors install various floor coverings in both commercial buildings and residences. They measure, cut, stretch, and lay carpeting, while gluing, stapling or otherwise securing flooring such as wood or laminate. Carpet is a soft floor covering made of bound carpet fibers or stapled fibers. This type of flooring is typically used indoors and can be used in both high and low traffic areas. It typically lasts for 15-18 years before it needs to be replaced. Where necessary different widths can be seamed together with a seaming iron and seam tape and it is fixed to a floor over a cushioned underlay (pad) using nails, tack strips, or adhesives.

Many different species of wood are fabricated into wood flooring in two primary forms: plank and parquet. Hardwoods are typically much more durable than softwoods. Reclaimed lumber has a unique appearance and is used in green (environmentally responsible) building. Wood flooring comes in both tiles and planks, and can have glue or staple installation.

There are various ways to install carpeting or hardwood flooring in a home or business today. You could use staples, nails or adhesives. You could also add tacks strips along the edges of the flooring. The only problem is that many of these methods are rigid and your floor is not. It is a living, breathing component of your home.

A common undertaking in the flooring business is the replacement, removal and repair of flooring on various items. Such flooring is commonly secured in place using staples, tacks, or adhesive, which hold the flooring to the structural subflooring. In flooring removal applications, such as carpet removal, it is common for the carpet underlayment to have been fastened to the subflooring material with staples. Because the underlayment is usually a soft padding material when it is removed, the fastening staples remain embedded in the subflooring material, requiring removal. Furthermore, the carpet padding may also be damaged by tearing or puncturing. If the carpet padding is to be reused, it is necessary to avoid such damage.

Accordingly, when the flooring is to be replaced, removed, or repaired, it is necessary to remove at least some of the staples. Removal of staples may be accomplished using one of a number of methods, the most common being wedging a tool beneath the staple and prying the staple from the underlying subflooring. For example, by using a screwdriver to wedge underneath the staple and pry it out. When removing staples in this fashion, it is common to use significant force to pry the staple from the underlying frame. This force may result in damage to the underlying subflooring as one end of the removal tool may scratch or dent the subflooring.

To cut costs, sometimes you'll find that heavy duty staple removers are made with plastic instead of metal. Plastic will degrade under high use conditions when removing large staples and eventually break. While reference will generally be made herein to staples, it will be understood that the invention applies broadly to cover all securement devices, including staples, tack strip nail and adhesive.

Tools for prying nail from a piece of wood are quite common. Most nails have heads that provide a grip for a pulling tool. Most pulling tools have a slot to grip the nail below the head, and operate as a lever with the fulcrum on the surface in which the nail is embedded, such as the tack strip. The common claw hammer is an example. Many more elaborate tools have been developed, and patented, but there remains room for improvement in respect of the smoothness of operation in guiding the tool around the nail, and in levering the nail out of the material in which it is embedded.

Another difficulty with the removal of flooring from the subflooring is if the padding was glued down. When removing glued down padding, it's important to get as much of the old adhesive off the subflooring as possible to provide a smooth surface for the new flooring.

BRIEF SUMMARY OF THE INVENTION

The present invention is a removal tool that includes a staple remover, a tack nail puller and a glue scraper providing flooring expect the basic tool need to perform the above services. This heavy-duty multi-purpose tool has a very distinct shape, but the contours do more than just provide a nice aesthetic component it also helps to give you leverage to pull out heavy duty staples. This design is enhanced with a comfortable dual rubber non-slip, easy grip handle. This high quality multi-purpose tool is very lightweight and durable and the unique design helps you remove multiple fasteners faster and easier for longer periods of time, without hurting your hand.

The primary object of the present invention is to provide a carpet padding staple removal tool that will overcome the shortcoming of prior devices. The device works with a pincer action to unfold and pull out a staple in one motion. Thin enough to get underneath a staple but smooth enough to prevent damaging your flooring. Set the staple remover forked blade as close to the wood as possible for maximum leverage and range of motion then slip the forked blade underneath the staple and use the prying plate oval shape to free the staple.

Another object is to provide a nail removal tool for removing tack strips nails without damaging the floor surface. Most nails have heads that provide a grip for a pulling tool. The present invention also has notch in it at both ends of the prying plate for the removal of nails. You slip the notch underneath the head of the nail and around the nail's shank then using the prying plate as a lever in conjunction with the padded handle pulling the nail out of the flooring.

An additional object is to provide a glue removal tool that will remove the glue residue leftover from the removal of different type of flooring. The glue scraper device of the present invention with its beveled edge allows the glue scraper to assume nearly a right angular position to the floor surface. Then slip the thin sharp tip under the residue glue prying it up and away from the flooring surface.

The glue scraper tool of the apparatus of the invention is useful for removing adhesive residue or carpet backing from tight corners or vertical surfaces such as stairs. The present invention is a revolutionary tool that does all the work of a pry bar and scraper without the damage.

The present invention is made from hardened tool steel for bullish strength and can be manufactured and mass produced by any fabrication facility by machining, cutting, forming and welding the steel.

DESCRIPTION OF CERTAIN EMBODIMENT OF THE PRESENT INVENTION

In the following detailed description of the preferred embodiment, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
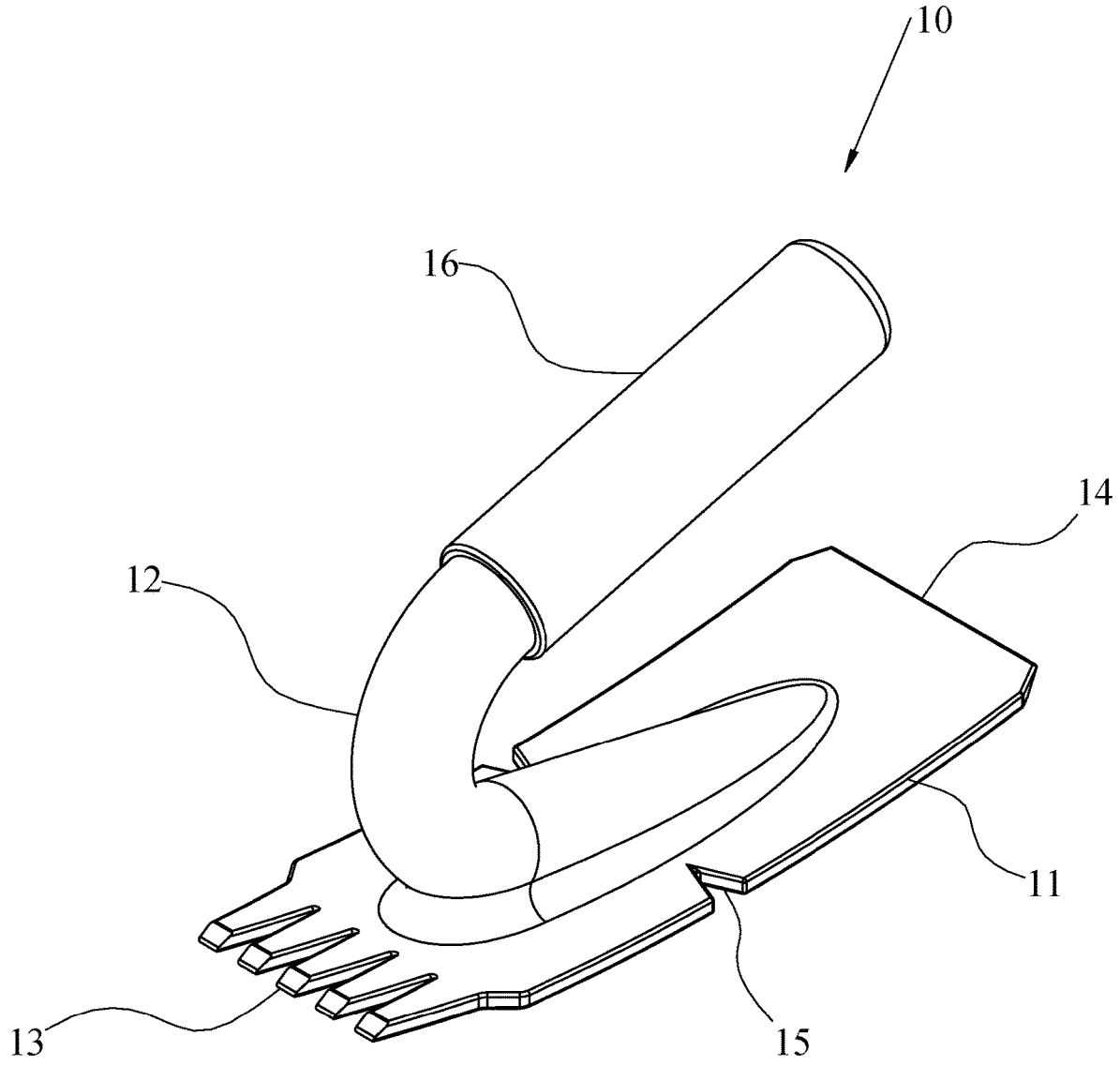
FIG. 1 is an isometric view of the multi-purpose tool of the present invention, with various tools of the multi-purpose tool illustrated in an open configuration.
Figure 2:
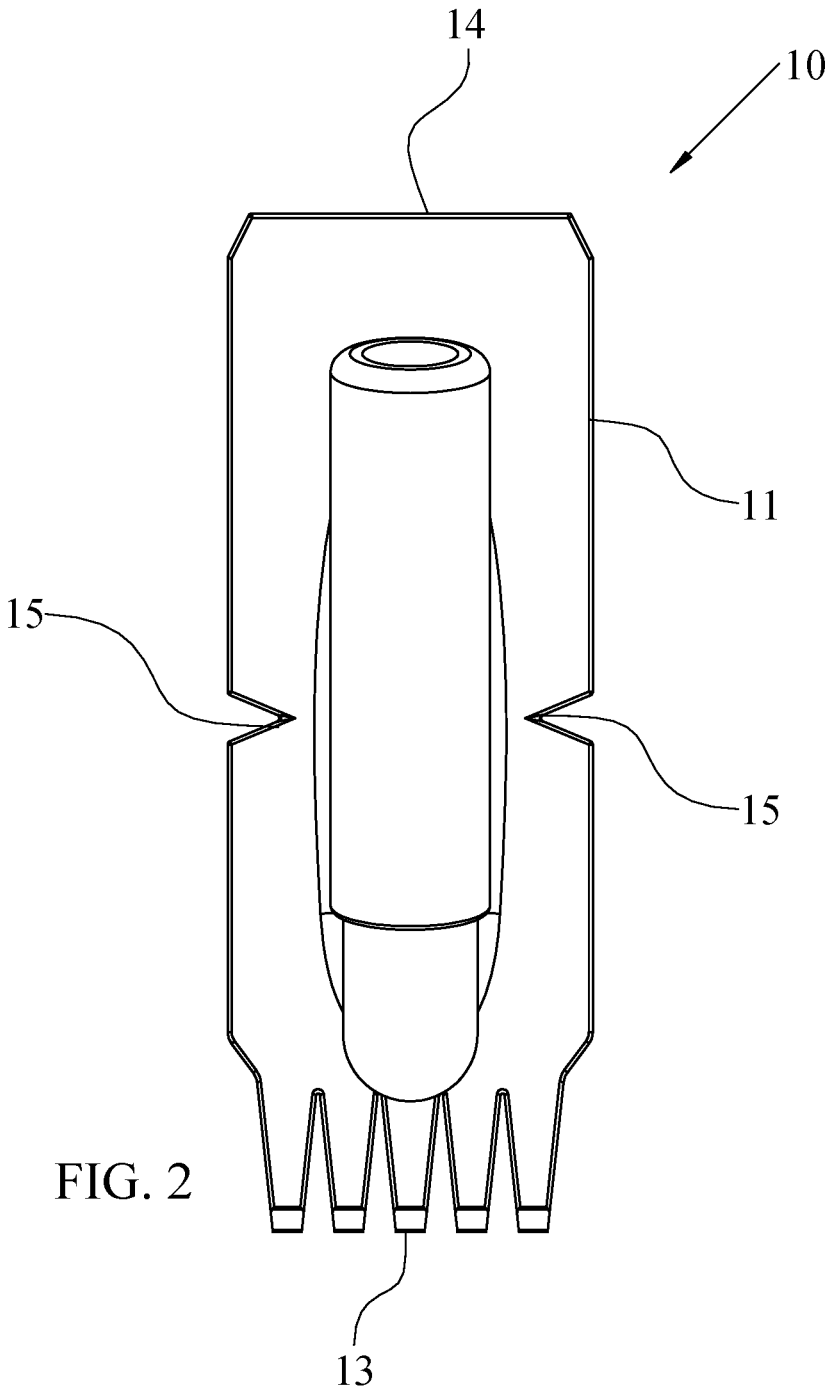
FIG. 2 is a top plan view of the multi-purpose tool shown in FIG. 1 showing the staple remover at one end, tack strip nail puller on the side and the glue scraper at the other end.
Figure 3:
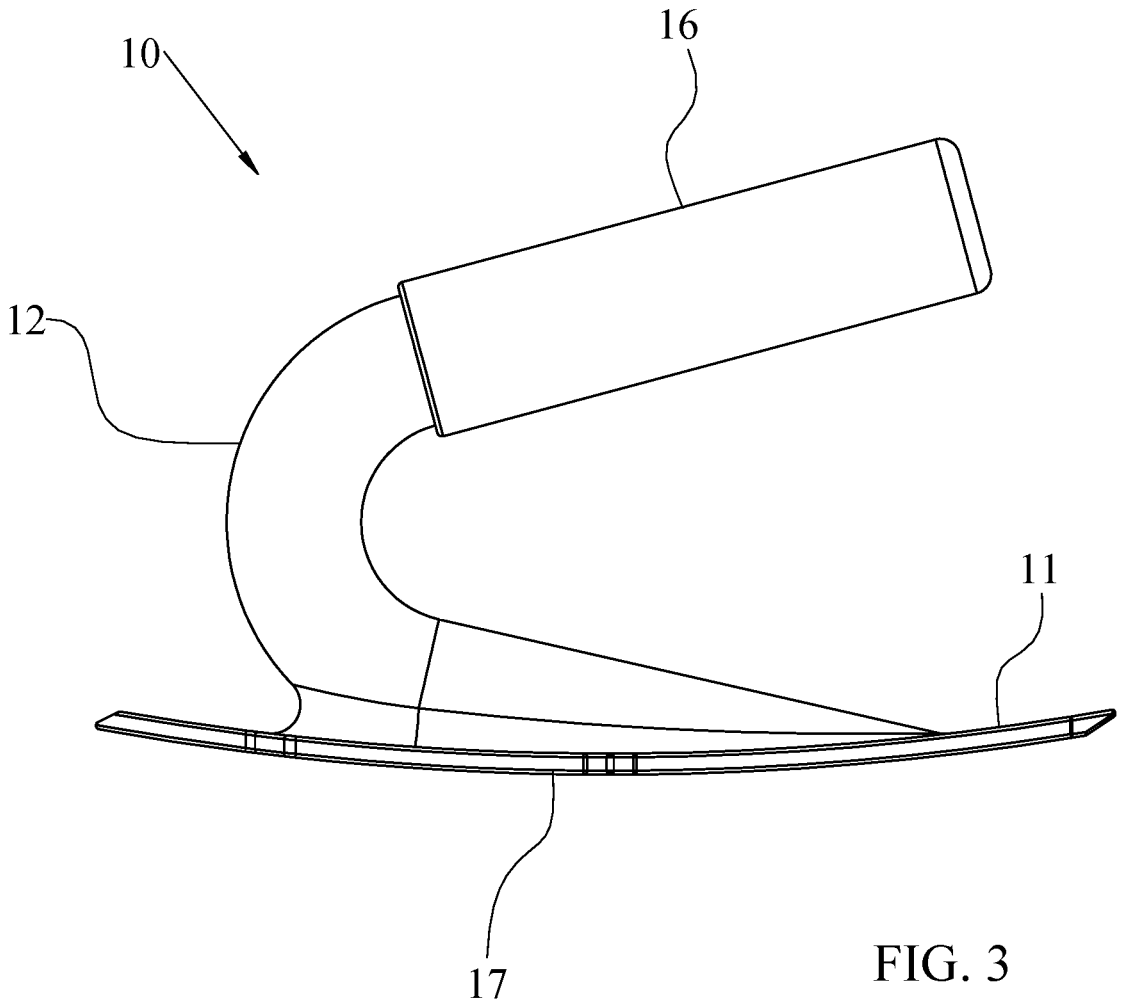
FIG. 3 is a side elevation view of a preferred embodiment of the multi-purpose tool in accordance with the present invention.
Figure 4:
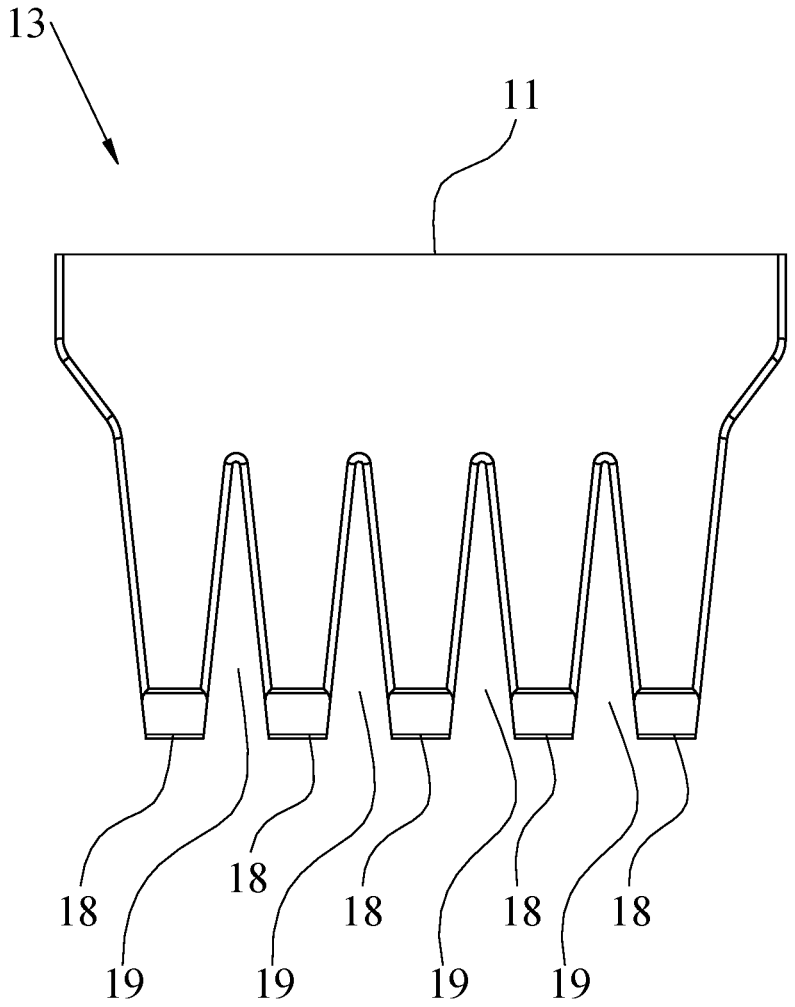
FIG. 4 is a top view of the forked blade of the staple remover portion of the multi-purpose tool according to an embodiment of the present invention of FIG. 1.
Figure 5:
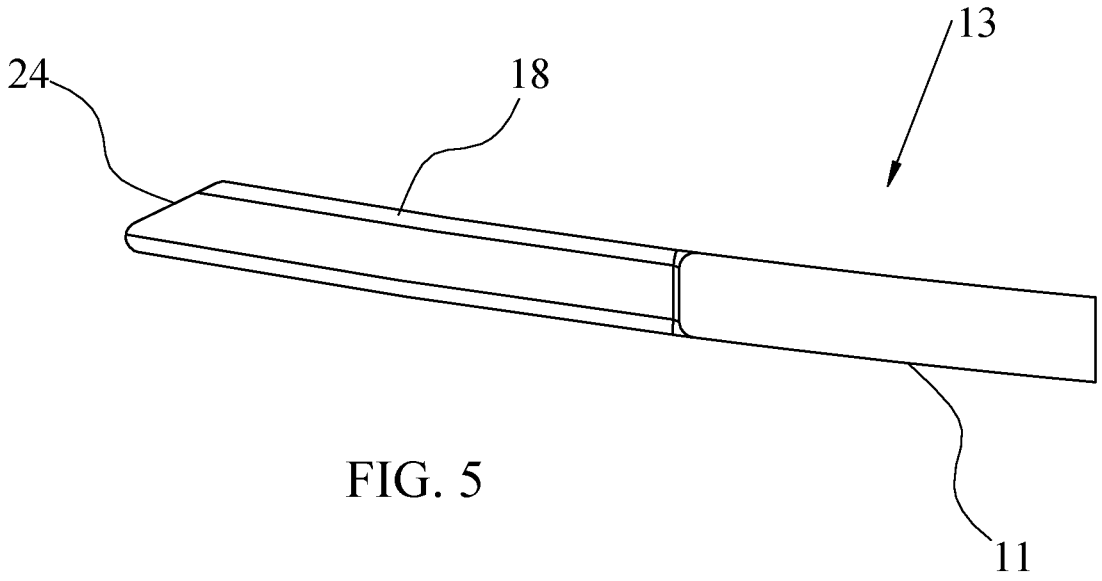
FIG. 5 is a crossed sectional view of staple remover portion of the multi-purpose tool of FIG. 4 showing the forked blade used for slipping underneath staples.
Figure 6:
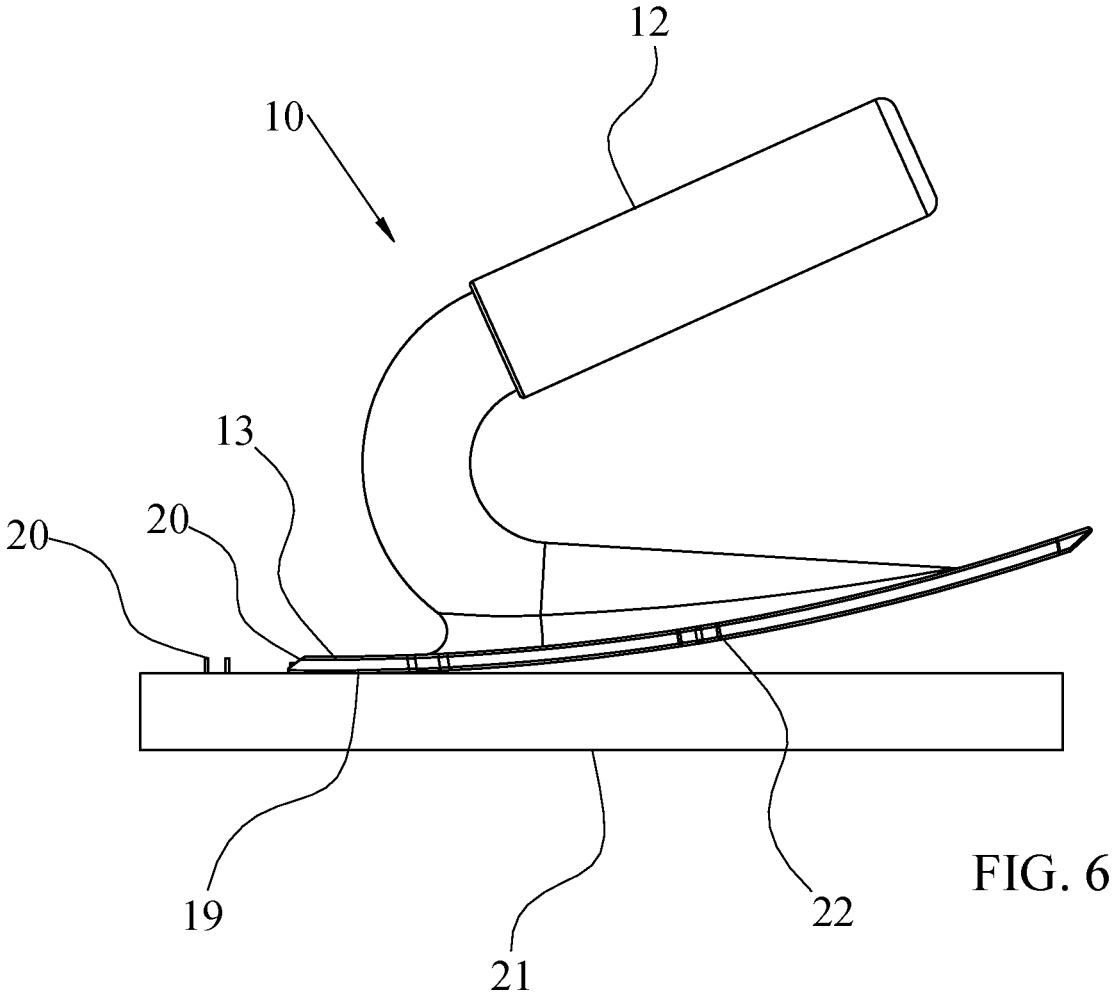
FIG. 6 is a side elevation view of the multi-purpose tool shown in FIG. 1 being used to remove a staple.
Figure 6A:
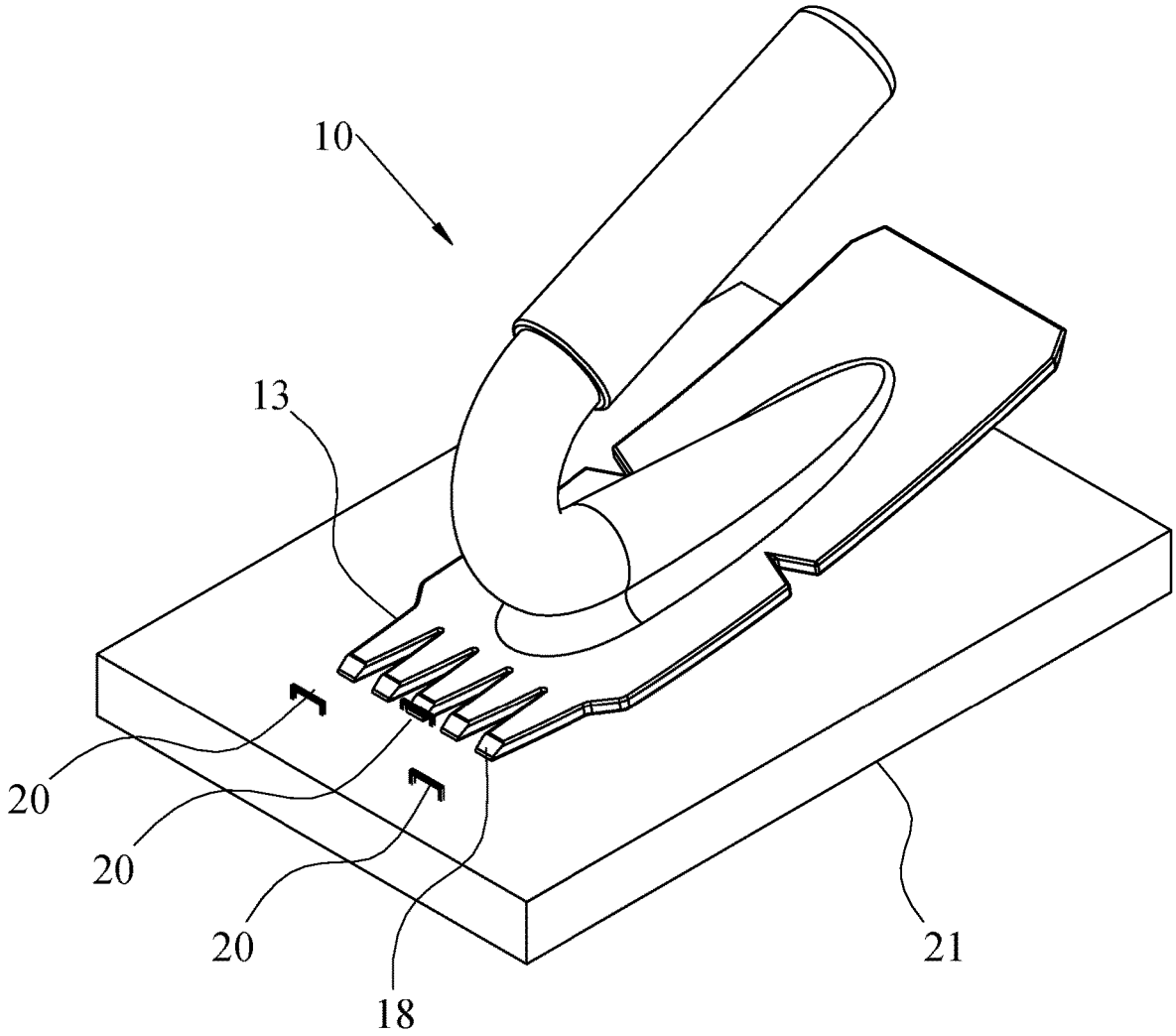
FIG. 6A is a perspective view of the multi-purpose tool shown in FIG. 1 being used to remove a staple.
Figure 7:
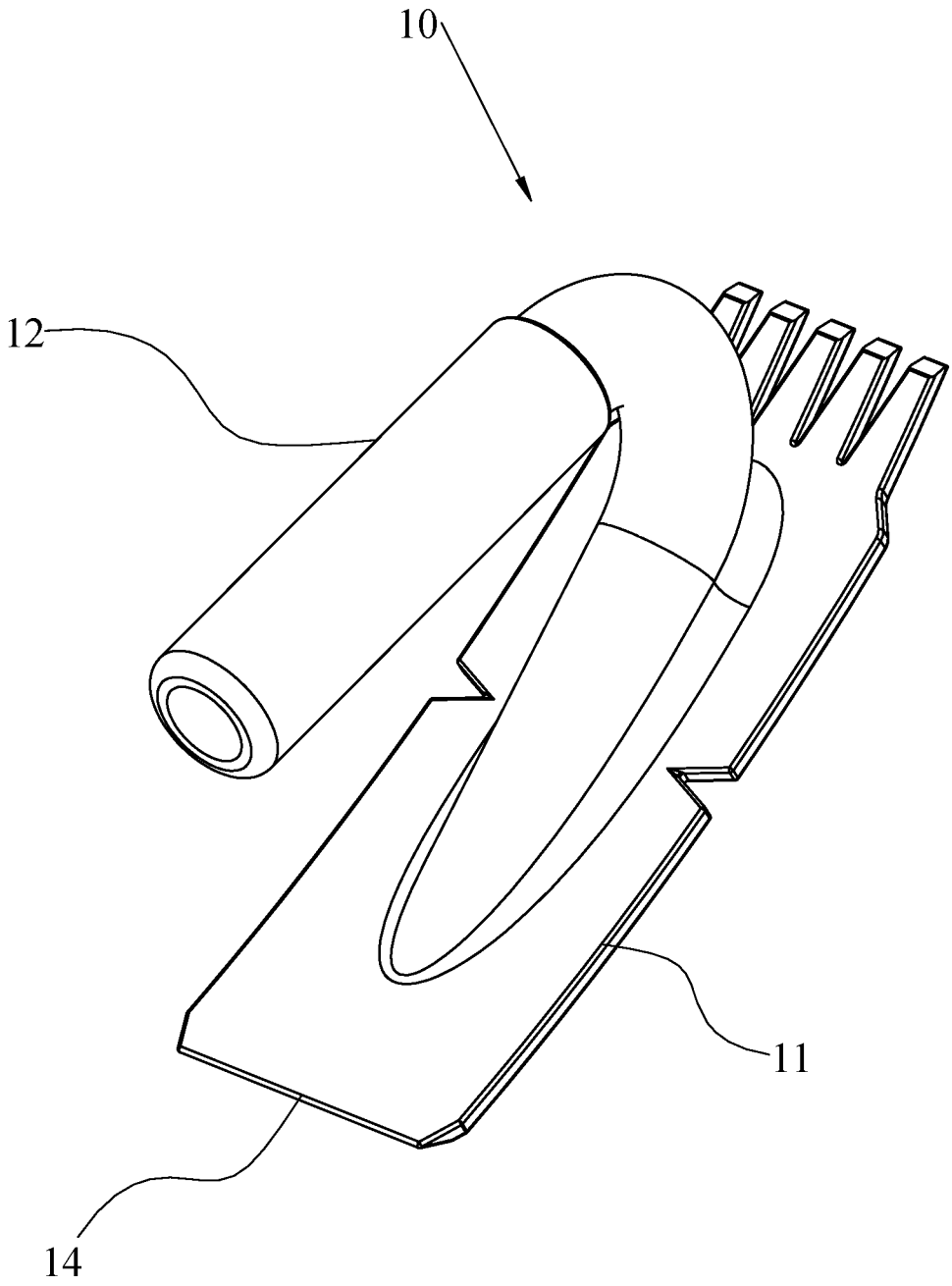
FIG. 7 is a perspective view showing the glue scraper portion of the multi-purpose tool according to an embodiment of the present invention of FIG. 1.
Figure 8:
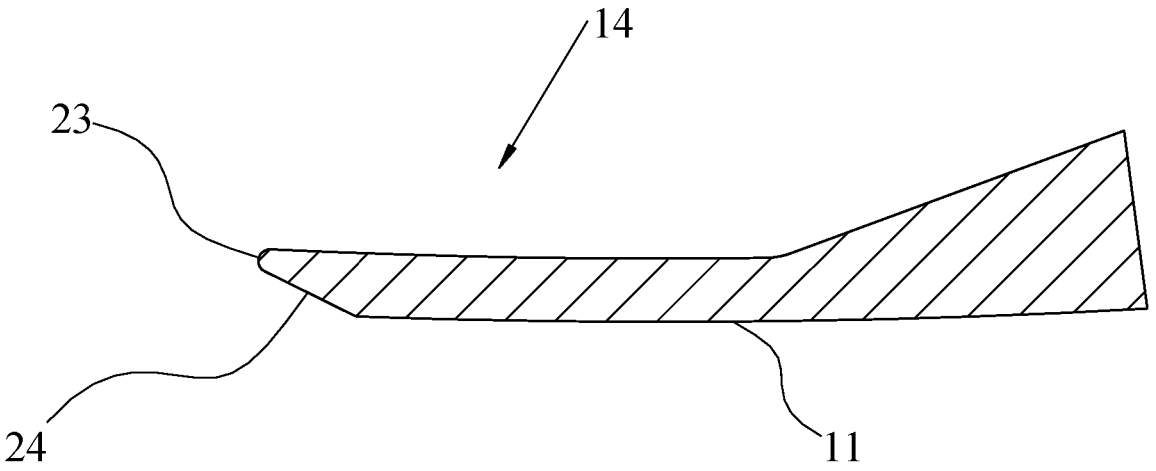
FIG. 8 is a crossed sectional view of glue scraper portion of the multi-purpose tool of FIG. 7 showing the shape tip and bevel edge used for scraper glue residue.
Figure 9:
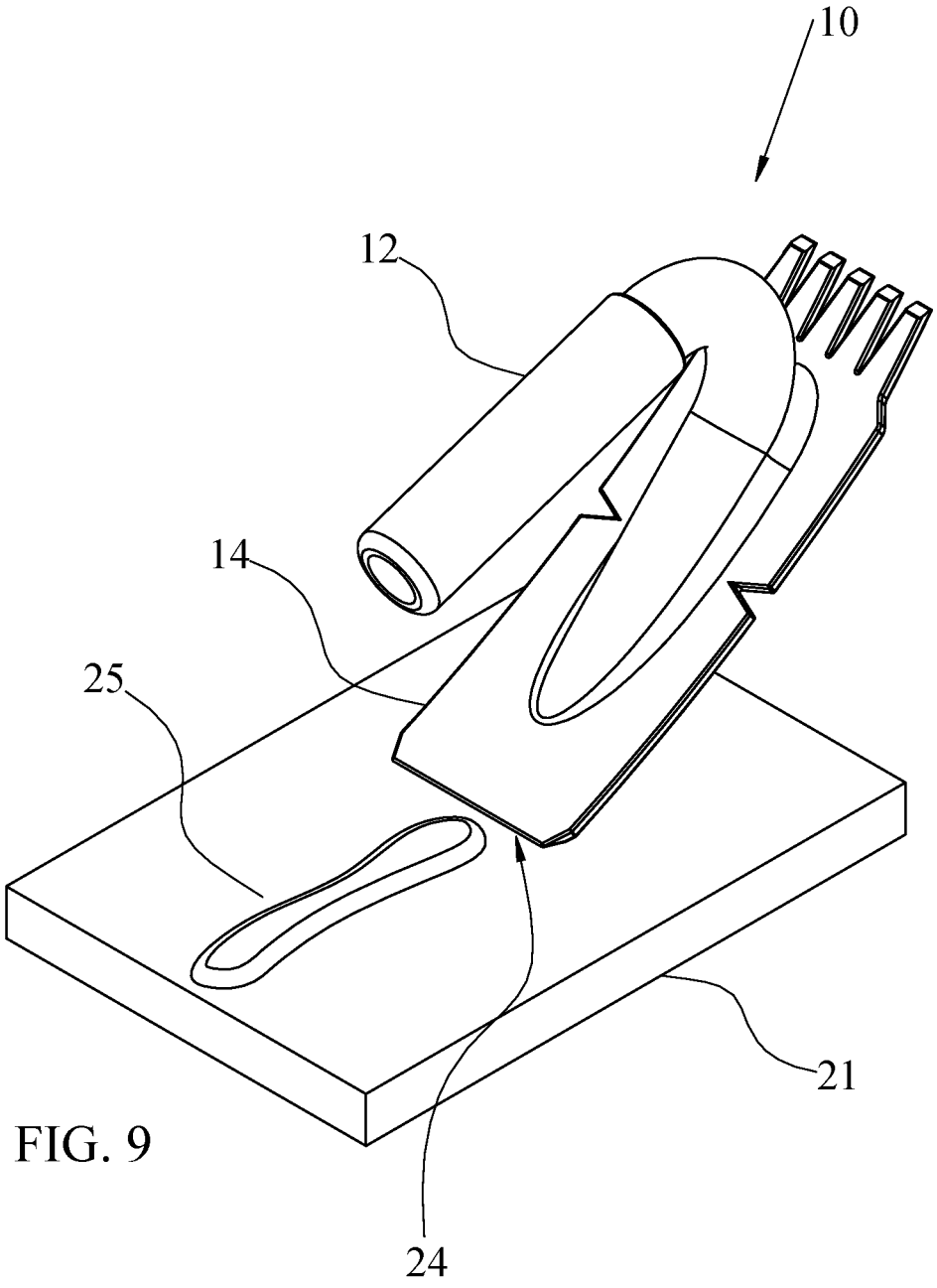
FIG. 9 is a perspective view of the multi-purpose tool shown in FIG. 1 being used to remove a glue residue.
Figure 10:
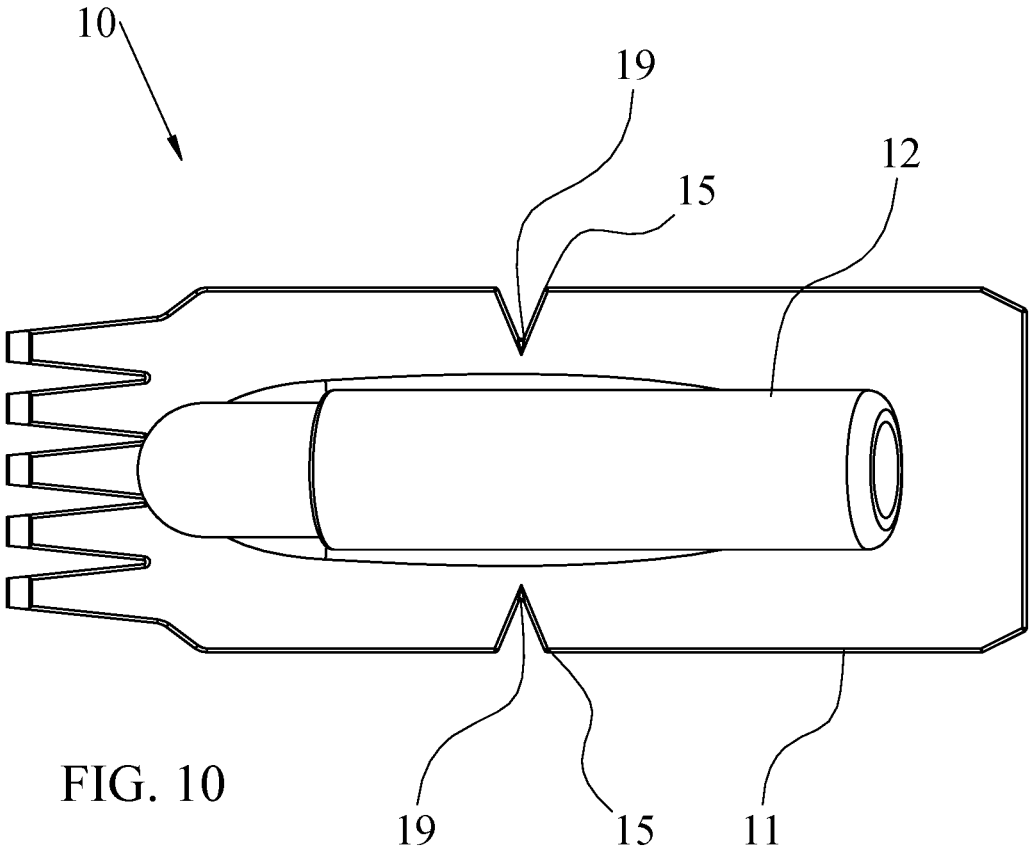
FIG. 10 is a top view of the tack strip nail puller 15 portion of the multi-purpose tool according to an embodiment of the present invention of FIG. 1.
Figure 11:
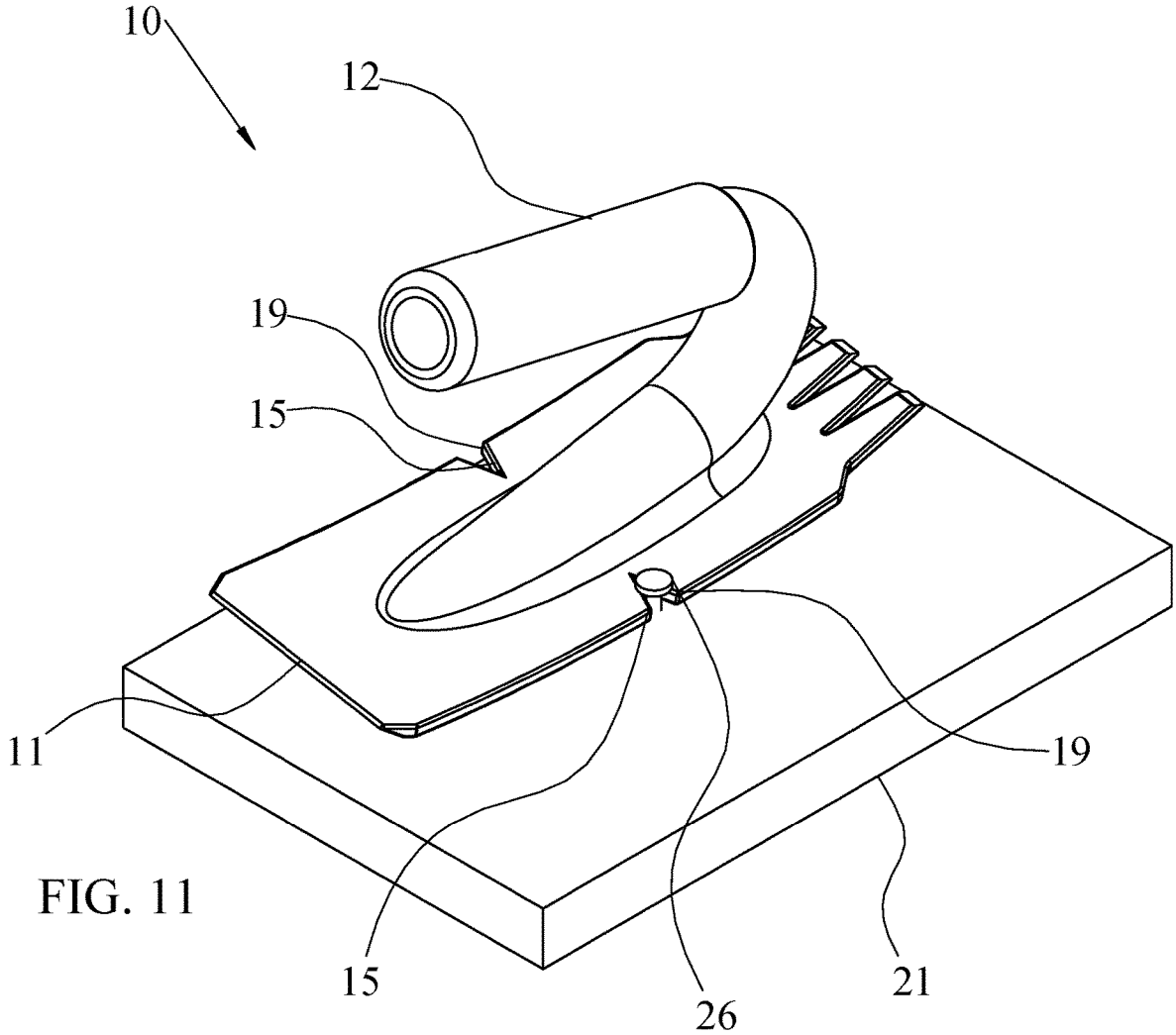
FIG. 11 is a perspective view of the multi-purpose tool shown in FIG. 1 being used to remove a tack strip nail.
Figure 11A:
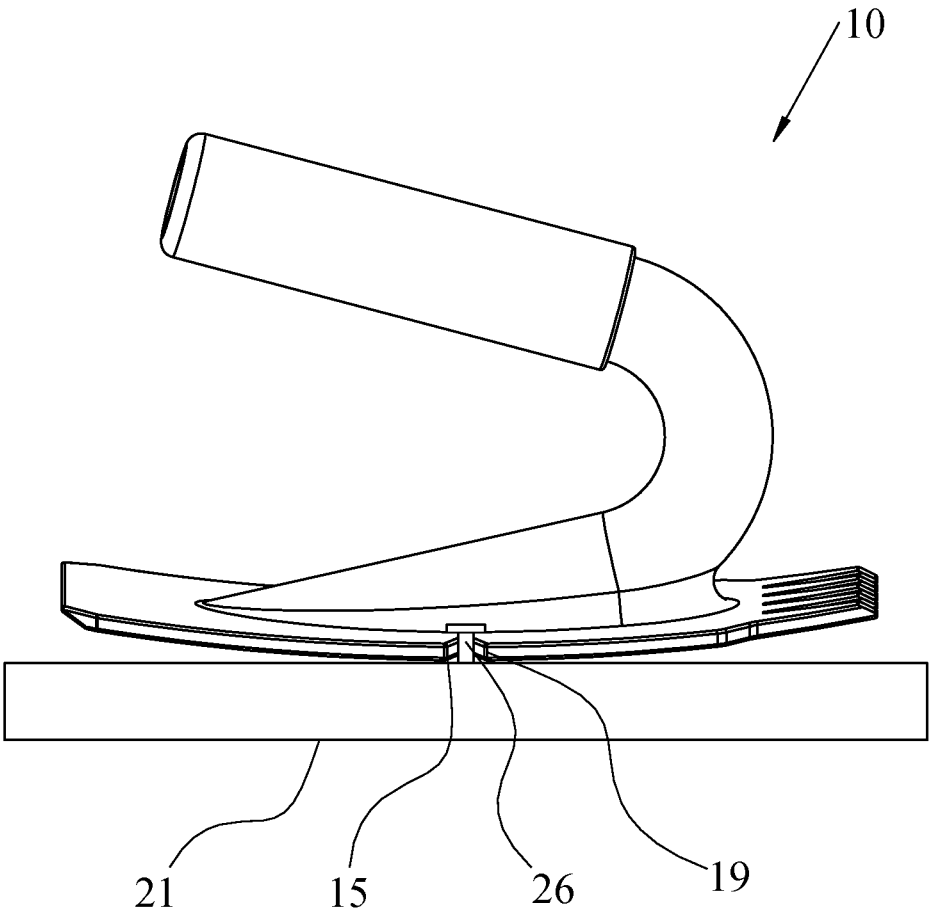
FIG. 11A is a perspective view of the multi-purpose tool shown in FIG. 1 being used to remove a tack strip nail.

The present invention shown in FIG. 1, is an isometric view of the multi-purpose tool 10 of the present invention, comprised a prying plate 11, a staple remover 13, tack strip nail puller 15, a glue scraper 14 and an handle 12 with a comfortable non-slip pad 16. As generally shown in FIG. 2 is a top plan view of the multi-purpose tool 10 shown in FIG. 1. Includes an prying plate 11, a staple remover 13 at one end, tack strip nail puller 15 on both sides, the glue scraper 14 at the other end and the handle 12 with a comfortable non-slip pad 16, in accordance with embodiments of the present invention. As generally shown in FIG. 3 is a side elevation view of a preferred embodiment of the multi-purpose tool 10 in accordance with the present invention showing oval shape 17 of the prying plate 11 combine with the padded 16 handle 12 establishes a greater leverage capability that improves the utility of the multi-purpose tool 10. As best seen in FIG. 4 is a top view of the forked blade 18 of the staple remover 13 portion of the multi-purpose tool 10 more specifically the arrangement of notches 19 and forked blade 18 with blunt prong tips located on the prying plate 11 used for slipping underneath staples. As generally shown in FIG. 5 is a crossed sectional view of prying plate 11 more specifically the staple remover 13 showing the forked blade 18 with its bevel edge 24 used for slipping underneath staples. In accordance with embodiments of the present invention FIG. 6 is a side elevation view of the multi-purpose tool 10 shown in FIG. 1 being used to remove a staple 20. For example, flooring 21 may represent a surface from which staples 20 are to be removed. In use, the prying plate 11 is typically moved laterally relative to the surface with the forked blade 18 and shape tip 23 may engage and remove the staple 20. Once a forked blade 18 engages the crown of the staple 20, downward movement with the handle 12 moving the prying plate 11 on the leverage axis 22 of the oval shape 17, in most cases, sufficient to free the staple 20 from the surface. Moreover, as shown in FIG. 6A, is a perspective view of the multi-purpose tool 10 and the flooring surface 21 more specifically as mentioned above the positioning of the forked blade 18 of the staple remover 13 in relationship to the staples 20. As generally shown in FIG. 7 is a perspective view showing the glue scraper 14 portion of the multi-purpose tool 10 with the prying plate 11 and handle 12 in accordance with embodiments of the present invention. As generally shown in FIG. 8 is a crossed sectional view of prying plate 11, more specifically the glue scraper 14 showing the shape tip 23 with its bevel edge 24 used for scraper glue residue. In accordance with embodiments of the present invention FIG. 9, is a perspective view of the multi-purpose tool 10 being used to remove glue residue. In use, the handle 12 and prying plate 11 is typically position perpendicular and moved laterally to the flooring surface 21 removing the glue residue 25. More specifically the glue scraper 14 has a bevel edge 24 to allow the glue scraper 14 to assume more nearly a right angular position to the floor surface 21, in many cases, sufficient to free the glue residue 25 from the surface. As generally shown in FIG. 10, is a top plan view of showing the nail puller 15 portion of the multi-purpose tool 10 shown in FIG. 1 includes an prying plate 11, a nail slot 27 on both sides, and the handle 12 In accordance with embodiments of the present invention. FIG. 11 is a perspective view showing the tack strip nail puller 15 portion of the multi-purpose tool 10 shown in FIG. 1 being used to remove a nails 26. For example, flooring 21 may represent a surface from which nails 26 are to be removed. In use, the nail slot 27 is typically move laterally relative to the nail 26 more specifically the nail slot 27 engages the nail 26 where the force moving prying plate 11 by the handle 12 will, in most cases, sufficient to free the nail 26 from the surface. Moreover, as shown in FIG. 11A, is a side elevation view showing the tack strip nail puller 15 portion of the multi-purpose tool 10 and the flooring surface 21 more specifically as mentioned above the positioning of the nail slot 27 of the tack strip nail puller 15 in relationship to the nails 26.

CONCLUSION

A common undertaking in the flooring business is the replacement, removal and repair of flooring on various items. Such flooring is commonly secured in place using staples, tacks, or adhesive, which hold the flooring to the structural subflooring. When removing fasteners or glue down flooring, such as carpet or wood, it is important to get as much of the fasteners, glue off the subflooring as possible to provide a smooth surface for the new flooring. The primary object of the present invention is to provide a removal tool that will overcome the shortcoming of prior devices.

What is claimed is:

1. A tool for removing floor covering fasteners and adhesives comprising:

a curved plate having a first end and a second end opposite said first end, a first side and a second side opposite said first side, a top surface and a bottom surface, said top surface being concave and said bottom surface being convex, said bottom surface at said first end defining a front most peripheral edge of said curved plate, said top surface at said second end defining a rearmost peripheral edge of said curved plate, said first end comprising a plurality of forked blades, said plurality of forked blades comprising a first outermost forked blade, a second outermost forked blade and a plurality of inner forked blades extending between said first outermost forked blade and said second outermost forked blade, said first outermost forked blade being inset from said first side and said second outermost forked blade being inset from said second side, adjacent ones of said plurality of forked blades having a notch extending there between, each said notch converging from said first end in a direction toward said second end of said curved plate, each said forked blade having a sloped portion defining a beveled edge extending from said top surface to said front most peripheral edge;

said second end having a sloped portion defining a beveled edge extending from said bottom surface to said rearmost peripheral edge;

said first side and said second side each having a notch converging in a direction toward said center portion of said curved plate, each said notch configured to remove a nail from a tack strip;

a handle connected to said top surface and having a first portion extending from said top surface in a direction toward said first end, a curved portion extending from an end of said first portion and terminating in a second portion, said second portion extending from said curved portion and terminating in a free distal end.

* * * * *